US008967504B2

(12) United States Patent
Dallimore et al.

(10) Patent No.: US 8,967,504 B2
(45) Date of Patent: Mar. 3, 2015

(54) HORIZONTAL SHAFT IMPACT CRUSHER

(75) Inventors: Rowan Dallimore, Bath (GB); Knut Kjaerran, Svedala (SE); Andreas Forsberg, Malmö (SE)

(73) Assignee: Sandvik Intellectual Property AB, Sandviken (SE)

( * ) Notice: Subject to any disclaimer, the term of this patent is extended or adjusted under 35 U.S.C. 154(b) by 287 days.

(21) Appl. No.: 13/641,349

(22) PCT Filed: Mar. 4, 2011

(86) PCT No.: PCT/EP2011/053346

§ 371 (c)(1),
(2), (4) Date: Feb. 28, 2013

(87) PCT Pub. No.: WO2011/128155

PCT Pub. Date: Oct. 20, 2011

(65) Prior Publication Data

US 2013/0146692 A1 Jun. 13, 2013

(30) Foreign Application Priority Data

Apr. 16, 2010 (SE) ..... 1050377

(51) Int. Cl.
*B02C 13/09* (2006.01)
*B02C 25/00* (2006.01)

(52) U.S. Cl.
CPC ..... *B02C 13/095* (2013.01); *B02C 25/00* (2013.01)
USPC ..... 241/27; 241/37; 241/101.3; 241/189.1

(58) Field of Classification Search
CPC ..... B02C 13/09; B02C 13/095; B02C 13/31; B02C 2210/01
USPC ..... 241/101.3, 189.1, 275, 27, 37
See application file for complete search history.

(56) References Cited

U.S. PATENT DOCUMENTS 3,480,214 A 11/1969 Wageneder
3,659,794 A 5/1972 Hemesath (Continued)

FOREIGN PATENT DOCUMENTS

CN 2643998 Y 9/2004
CN 2915256 Y 6/2007

(Continued)

OTHER PUBLICATIONS

European Search Report for PCT/EP2011/053346, dated May 23, 2011.

(Continued)

*Primary Examiner* — Mark Rosenbaum
(74) *Attorney, Agent, or Firm* — Morgan, Lewis & Bockius LLP

(57) ABSTRACT

A horizontal shaft impact crusher comprises a crusher housing having an inlet for material to be crushed, an outlet for material that has been crushed, an impeller being mounted on a horizontal shaft in the crusher housing and being operative for rotating around a horizontal axis, a curtain against which material accelerated by the impeller may be crushed, and an adjustment bar for adjusting the position of said curtain relative to the impeller. The crusher is further provided with a cross beam to which said adjustment bar is connected, said crossbeam being adjustable relative to the impeller, and a curtain position indicator device indicating the position of the cross beam relative to the impeller, thereby indicating the position of the curtain relative to the impeller.

19 Claims, 8 Drawing Sheets

(56) References Cited

U.S. PATENT DOCUMENTS

| | | | | |
|---|---|---|---|---|
| 3,788,562 | A | 1/1974 | Greenlay et al. | |
| 4,017,035 | A | 4/1977 | Stuttmann | |
| 5,226,604 | A * | 7/1993 | Seiffert et al. | 241/30 |
| 5,255,869 | A | 10/1993 | Smith | |
| 5,713,527 | A | 2/1998 | Hemesath et al. | |
| 6,070,819 | A | 6/2000 | Young et al. | |
| 6,089,481 | A | 7/2000 | Young | |
| 6,189,820 | B1 | 2/2001 | Young | |
| 6,637,680 | B1 | 10/2003 | Young et al. | |
| 6,745,966 | B2 | 6/2004 | Heukamp | |
| 7,293,725 | B2 * | 11/2007 | Moriya et al. | 241/37 |
| 7,942,356 | B2 | 5/2011 | Dallimore et al. | |
| 2011/0253822 | A1 | 10/2011 | Dallimore et al. | |

FOREIGN PATENT DOCUMENTS

| | | |
|---|---|---|
| DE | 39 11 086 | 4/1990 |
| DE | 43 12 509 | 10/1994 |
| DE | 94 13 571.1 | 5/1995 |
| EP | 0 728 524 | 8/1996 |
| EP | 1 964 612 | 9/2008 |
| ES | 2 289 885 | 2/2008 |
| FR | 2 893 863 | 6/2007 |
| WO | 2007/110744 | 10/2007 |

OTHER PUBLICATIONS

International Bureau PCT: International Preliminary Report on Patentability including Written Opinion for Application No. PCT/SE2011/050336—Issued Oct. 16, 2012.

International Bureau PCT: International Preliminary Report on Patentability including Written Opinion for Application No. PCT/EP2011/053346—Issued Oct. 16, 2012.

SIPO: First Office Action for Chinese Patent Application No. 201180019400.1—Issued Dec. 12, 2013 (Including English Translation).

SIPO: First Office Action for Chinese Patent Application No. 201180019393.5—Issued Dec. 4, 2013 (Including English Translation).

* cited by examiner

HORIZONTAL SHAFT IMPACT CRUSHER

TECHNICAL FIELD OF THE INVENTION

The present invention relates to a horizontal shaft impact crusher comprising a crusher housing having an inlet for material to be crushed, an outlet for material that has been crushed, an impeller being mounted on a horizontal shaft in the crusher housing and being operative for rotating around a horizontal axis, a curtain against which material accelerated by the impeller may be crushed, and an adjustment bar for adjusting the position of said curtain relative to the impeller.

The present invention further relates to a method for adjusting a horizontal shaft impact crusher.

BACKGROUND ART

Horizontal shaft impact crushers are utilized in many applications for crushing hard material, such as pieces of rock, ore etc. A horizontal shaft impact crusher has an impeller that is made to rotate around a horizontal axis. Pieces of rock are fed towards the impeller and are struck by beater elements mounted on the impeller. The pieces of rock are disintegrated by being struck by the beater elements, and are accelerated and thrown against breaker plates, often referred to as curtains, against which further disintegration occurs. The action of the impeller thus causes the material fed to the horizontal shaft impact crusher to move freely in a crushing chamber and to be crushed upon impact against the beater elements, against the curtains, and against other pieces of material moving around at high speed in the crushing chamber.

Furthermore, adjustment of the position of the curtain may be made to compensate for both curtain wear and beater element wear. Adjustment of the position of the curtain may be also made to adjust the size of the crushed material.

EP 0 728 524 discloses a horizontal shaft impact crusher which is provided with supporting hydraulic cylinders for adjusting and maintaining the position of the curtain. The crusher is further provided with a path measuring system which enables reading of the curtain position.

However, the design of the crusher described in EP 0 728 524 is considered to be complex and may be costly to manufacture and/or operate.

SUMMARY OF THE INVENTION

It is an object of the present invention to provide a simple and robust horizontal shaft impact crusher.

This object is achieved by means of a horizontal shaft impact crusher comprising a crusher housing having an inlet for material to be crushed, an outlet for material that has been crushed, an impeller being mounted on a horizontal shaft in the crusher housing and being operative for rotating around a horizontal axis, a curtain against which material accelerated by the impeller may be crushed, and an adjustment bar for adjusting the position of said curtain relative to the impeller, wherein the crusher is further provided with a cross beam to which said adjustment bar is connected, the crossbeam being adjustable relative to the impeller, and a curtain position indicator device indicating the position of the cross beam relative to the impeller, thereby indicating the position of the curtain relative to the impeller.

An advantage of this horizontal shaft impact crusher is that the adjustment of the curtains may be carried out in a simple and mechanically stable manner since the adjustment device may be arranged to slide easily along the guide rails when not retained by the retaining means. Furthermore, a robust and reliable mounting of the crusher curtains in different positions may be achieved. Since the curtain is connected to the cross beam the curtain position is derivable from the reading of the cross beam position, i.e. each cross beam position corresponds to a known curtain setting. This has the advantage that the curtain position, as well as movements during adjustment, can easily be read through a curtain position indicator device arranged on the outside of the crusher housing. Hence, predetermined curtain position adjustments needed due to e.g. wear of internal wear parts may be carried out without access to the inside of the crusher housing.

Adjustments of cross beam may thus be carried out in a simple manner with aid of the curtain position indicator device. By noting the position of the cross beam after an initial setting, it is a simple maintenance procedure to stop the crusher, adjust the cross beam a certain distance to compensate for e.g. wear and run the crusher again. This has the advantage that maintenance downtime can be reduced.

Movements carried out to adjust the curtain position may be recorded to an electronic crusher control system. Then, historically saved data can easily be used to predict future adjustments. Further, in addition to having access to readouts for the adjustments carried out, i.e. movements of the cross beam, it is easy to simultaneously record hours run during a crusher operation. With this option, the readout could show both total distance of movement combined with hours run recorded at each adjustment. This would enable the operator to verify wear parts usage over a period of time and thus help calculate cost per tonne of material passed through the crusher. It will thus further aid in predicting future maintenance intervals. Then, it will be easy to predict when to order replacement parts and also to calculate the wear life of wear parts. Furthermore, it is helpful when forecasting planned maintenance stops.

Preferably, the crossbeam extends parallel to the rotational axis of the impeller.

The crossbeam is preferably slidably arranged to the crusher housing in order to provide for a robust adjustable fastening of the cross beam to the crusher housing. Furthermore, adjustments can be carried out in a very controllable manner.

Preferably, the housing is provided with at least two guide rails to which said crossbeam is slidably connected, and retaining means which is arranged to hold, with a predetermined holding force, said crossbeam in a crusher operation position relative to the guide rails.

In one embodiment the retaining means comprises a pneumatic or a hydraulic device in order to enable adjustment of the curtain in a very simple manner by means of e.g. a small hydraulic cylinder. Furthermore, remote adjustments of the curtain position may be enabled by means of a hydraulic retaining device. Furthermore, a hydraulic retaining device has the advantage that that maintenance downtime can be even further reduced.

In one embodiment the retaining means comprises a hydraulic motor. This embodiment has the advantage that the cross beam may be retained by without the need of maintaining a hydraulic pressure in the hydraulic device.

The position indicator device may comprise a pointer mounted at an end of the crossbeam. In this way the curtain position is indicated in a very simple manner.

The position indicator device may further comprise a reading scale mounted on the housing for reading of the cross beam position to make it easier to read the curtain position.

In one embodiment the position indicator device comprises an electronic measuring device. The electronic measuring device may e.g. perform its measurement using an electronic sensor, such as an infrared sensor, an ultrasonic, or a laser sensor, transmitting a measurement signal that is reflected by the crusher housing and received by a receiver of the electronic sensor. This embodiment has the advantage that the curtain position as well as adjustments of the curtain can be indicated with a very high degree of accuracy. Furthermore, remote and/or automatic adjustments of the cross beam position, and thereby of the curtain position, controlled by an electronic control system are then enabled.

Preferably, such an electric sensor is mounted on the cross beam for measuring the position of the cross beam relative the impeller.

The electronic measuring device may be arranged to give a readout of the actual cross beam position to either the crusher control room, or to a remote screen mounted on or near the crusher.

Furthermore, a method for adjusting a setting of a horizontal shaft impact crusher is provided. The crusher comprises a crusher housing having an inlet for material to be crushed, an outlet for material that has been crushed, an impeller being mounted on a horizontal shaft in the crusher housing and being operative for rotating around a horizontal axis, a curtain against which material accelerated by the impeller may be crushed, and an adjustment bar for adjusting the position of said curtain relative to the impeller. The method involves loosening, by means of an actuator, a cross beam to which said adjustment bar is connected, thereby permitting said crossbeam to be adjusted relative to the impeller, adjusting the position of the cross beam, while monitoring the movement of the cross beam, until a desired position has been reached, and tightening, by means of the actuator, the cross beam to which said adjustment bar is connected.

According to one embodiment the method further comprises tightening by means of the actuator, the cross beam to a predetermined holding force, thereby permitting said cross beam to be adjusted relative to the impeller only if a force exceeding the predetermined holding force is transmitted from said curtain.

Further objects and features of the present invention will be apparent from the description and the claims.

BRIEF DESCRIPTION OF THE DRAWINGS

The invention will hereafter be described in more detail and with reference to the appended drawings.

DETAILED DESCRIPTION OF PREFERRED EMBODIMENTS OF THE INVENTION

Figure 1:
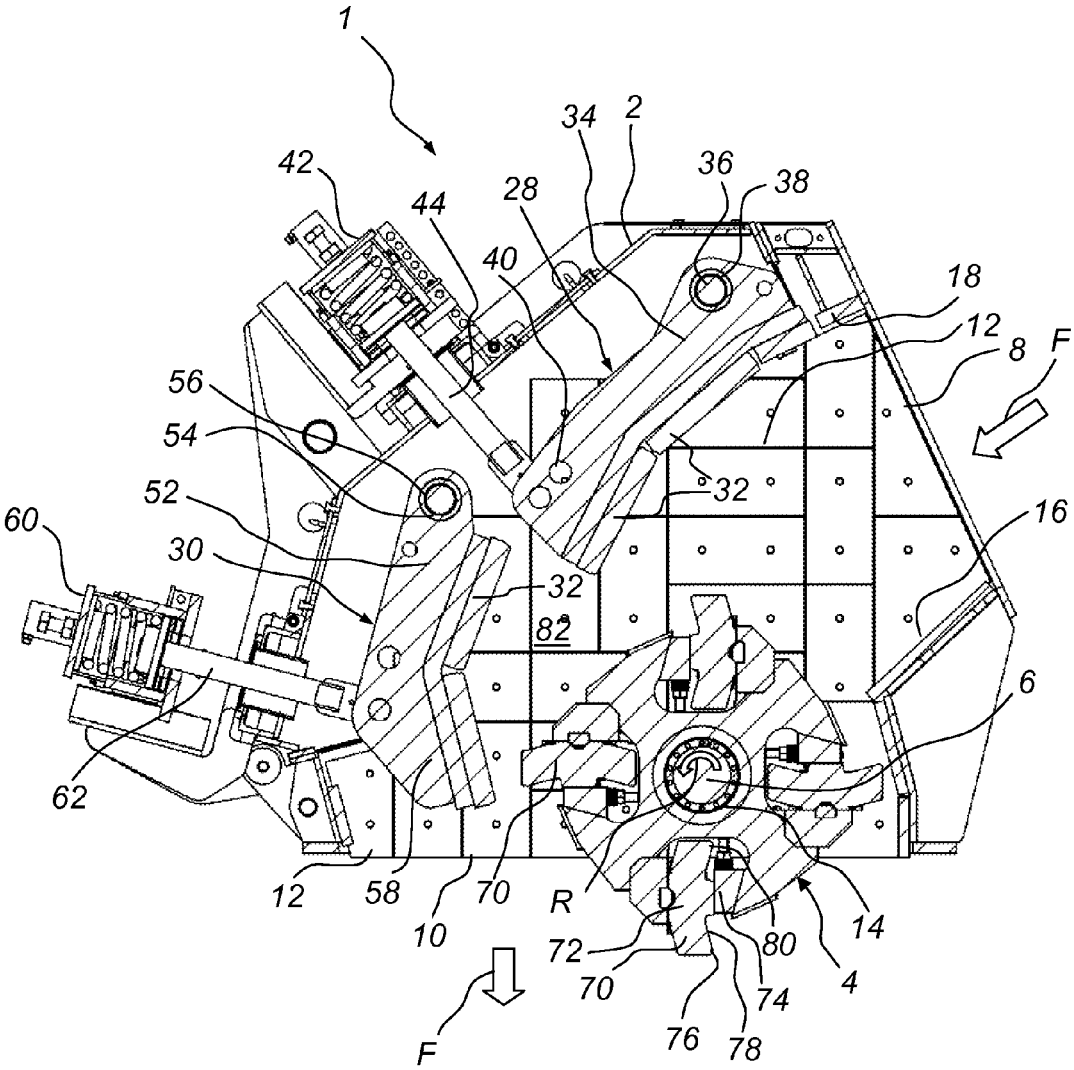
FIG. 1 is a section view and illustrates, schematically, a horizontal shaft impact crusher according to an embodiment of the present invention.

FIG. 1 is a cross-section and illustrates, schematically, a horizontal shaft impact crusher 1. The horizontal shaft impact crusher 1 comprises a housing 2 in which an impeller 4 is arranged. A motor, not illustrated for reasons of maintaining clarity of illustration, is operative for rotating a horizontal shaft 6 on which the impeller 4 is mounted. As alternative to the impeller 4 being fixed to the shaft 6, the impeller 4 may rotate around the shaft 6. In either case, the impeller 4 is operative for rotating around a horizontal axis, coinciding with the centre of the horizontal shaft 6.

Material to be crushed is fed to an inlet 8 for material to be crushed. The crushed material leaves the crusher 1 via an outlet 10 for material that has been crushed.

The housing 2 is provided with a plurality of wear protection plates 12 that are operative for protecting the walls of the housing 2 from abrasion and from impact by the material to be crushed. Furthermore, the housing 2 comprises a bearing 14 for the horizontal shaft 6. 1. A lower feed plate 16 and an upper feed plate 18 are arranged at the inlet 8. The feed plates 16, 18 are operative for providing the material fed to the crusher 1 with a suitable direction with respect to the impeller 4.

The crusher 1 comprises a first curtain 28, and a second curtain 30. Each curtain 28, 30 comprises at least one wear plate 32 against which material may be crushed.

A first end 34 of the first curtain 28 has been mounted by means of a horizontal first pivot shaft 36 extending through an opening 38 formed in said curtain 28 at said first end 34. The first pivot shaft 36 extends further through openings in the housing 2 to suspend said first end 34 in said housing 2. A second end 40 of said first curtain 28 is connected to a first adjustment device 42 comprising two parallel adjustment bars 44, of which only one bar 44 is visible in FIG. 1.

A first end 52 of the second curtain 30 has been mounted by means of a horizontal second pivot shaft 54 extending through an opening 56 formed in said curtain 30 at said first end 52. The second pivot shaft 54 extends further through openings in the housing 2 to suspend said first end 52 in said housing 2. A second end 58 of said second curtain 30 is connected to a second adjustment device 60 comprising two parallel adjustment bars 62, of which only one bar 62 is visible in FIG. 1. The second adjustment device 60 may be of a similar design as the first adjustment device 42, which will be described in more detail hereinafter.

The illustrated impeller 4 has four beater elements 70, each such beater element 70 having a bent shape, as seen in cross-section. Each beater element 70 has a central portion 72 which is operative for co-operating with a mounting block 74 being operative for pressing the back of the beater element 70 towards the impeller 4 to keep the beater element 70 in position. An arrow R indicates the direction of rotation of the impeller 4. A leading edge 76 of the beater element 70 extends in the direction of rotation R, such that a scoop-area 78 is formed between the central portion 72 and the leading edge 76. The beater element 70 is symmetric around its central portion 72, such that once the leading edge 76 has been worn out, the beater element 70 can be turned and mounted with its second leading edge 80 operative for crushing material. The area formed between the impeller 4 and the first and second curtains 28, 30 can be called a crushing chamber 82 of the crusher 1.

In operation, material to be crushed is fed to the inlet 8. The material will first reach the first curtain 28, being located upstream of the second curtain 30 as seen with respect to the direction of travel of the material. By means of the feed plates 16, 18 the material is directed towards the impeller 4 rotating at, typically, 400-850 rpm. When the material is hit by the beater elements 70 it will be crushed and accelerated against the wear plates 32 of the first curtain 28 where further crushing occurs. The material will bounce back from the first curtain 28 and will be crushed further against material travelling in the opposite direction and, again, against the beater elements 70. When the material has been crushed to a sufficiently small size it will move further down the crusher chamber 82, and will be accelerated, by means of the beater elements 70, towards the wear plates 32 of the second curtain 30, being located downstream of the first curtain 28. Hence, the material will move freely around in the crushing chamber 82, and will be crushed against the beater elements 70, against the wear plates 32 of the curtains 28, 30, and against other pieces of material circling around, at a high velocity, in the crusher 1. Arrows F indicate the path of the material through the crusher 1.

By adjusting the longitudinal position of the adjustment bar 44 in relation to the housing 2, the first curtain 28 may be pivoted around the first pivot shaft 36 until an optimum distance between the second end 40 and the impeller 4 has been obtained, with respect to the properties, as regards, e.g., size and hardness, of the material to crushed. Hence, the adjustability of the distance between the first curtain 28 and the impeller 4 is largest at that location, i.e., at the second end 40 of the first curtain 28, where the distance between the first curtain 28 and the impeller 4 is normally the smallest. In a similar manner the second adjustment device 60 may be utilized for making the second curtain 30 pivot around the second pivot shaft 54 until a suitable distance between the impeller 4 and the second end 58 of the second curtain 30 has been obtained.

Figure 2:
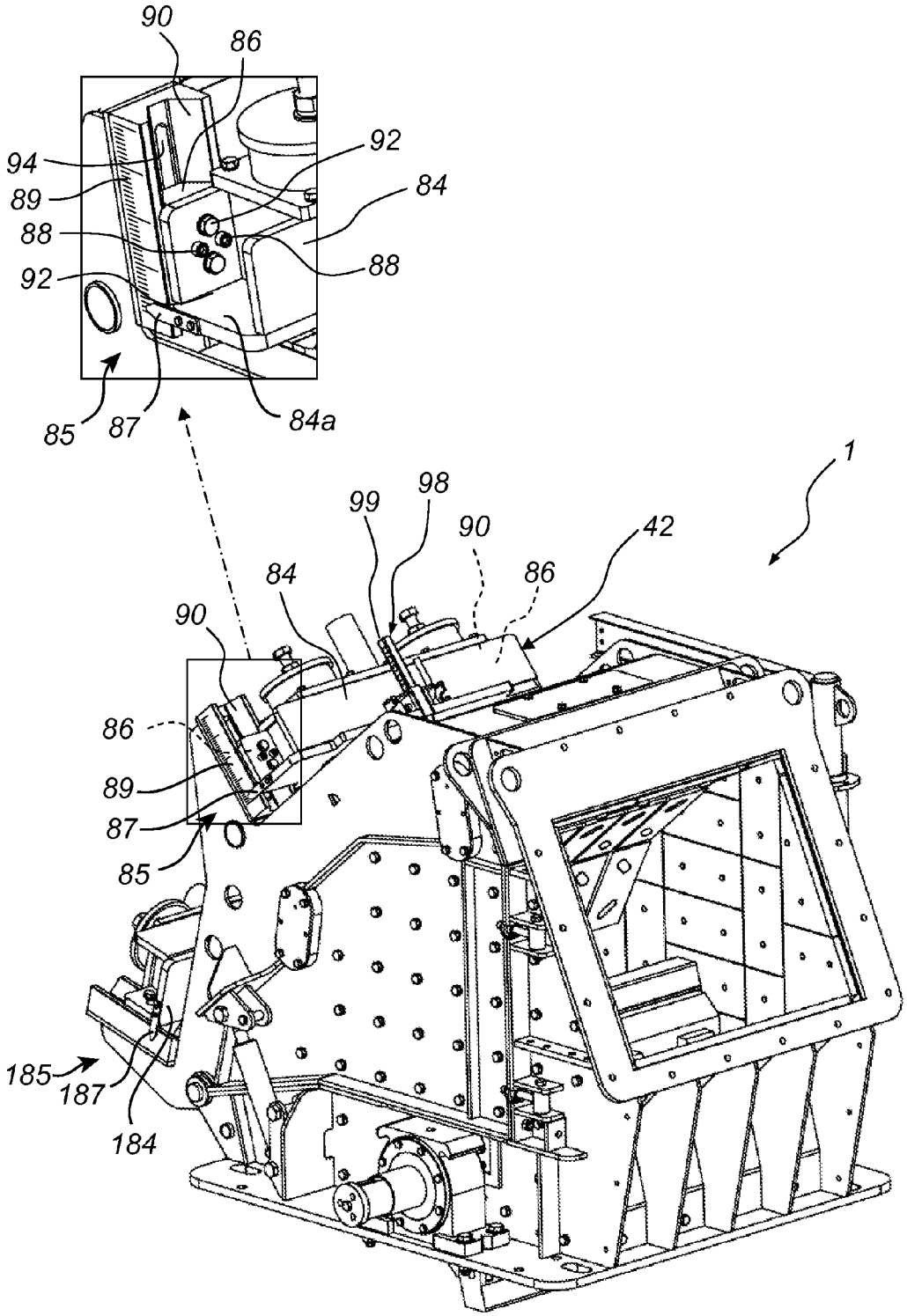
FIG. 2 is a perspective view of the crusher shown in FIG. 1.
Figure 3A:
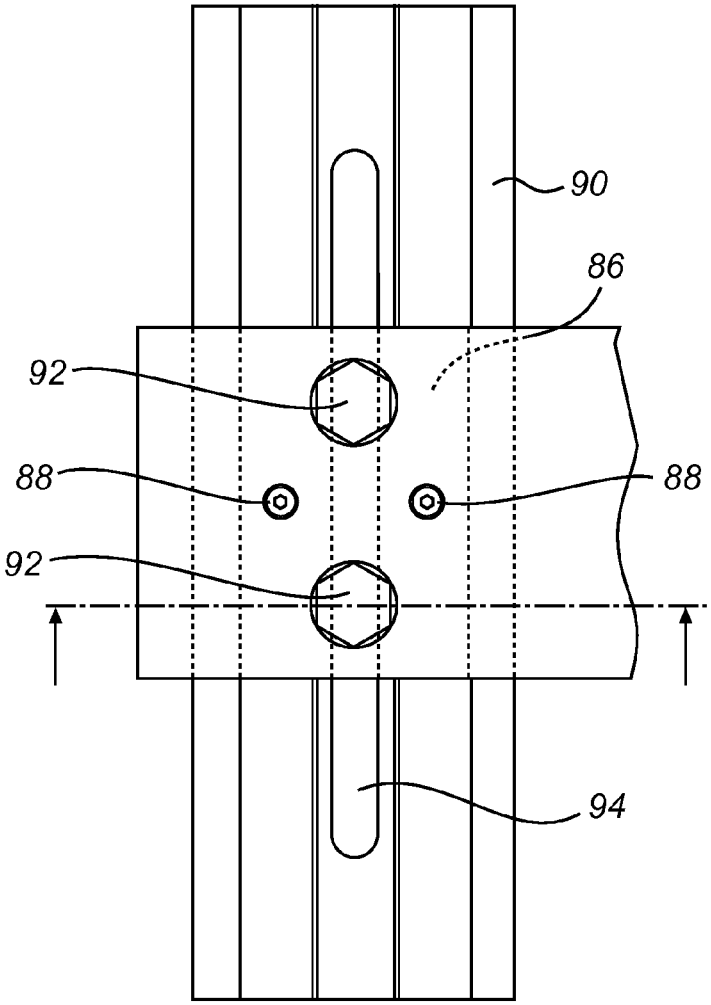
FIG. 3*a* is a plan view and illustrates, schematically, a guide block received in a guide rail of the crusher shown in FIG. 1.
Figure 3B:
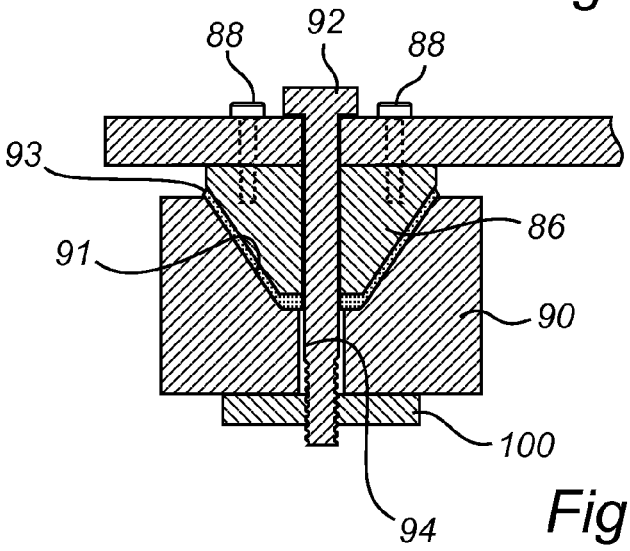
FIG. 3*b* is a section view and illustrates the guide block and guide rail shown FIG. 3*a*.
Figure 4:
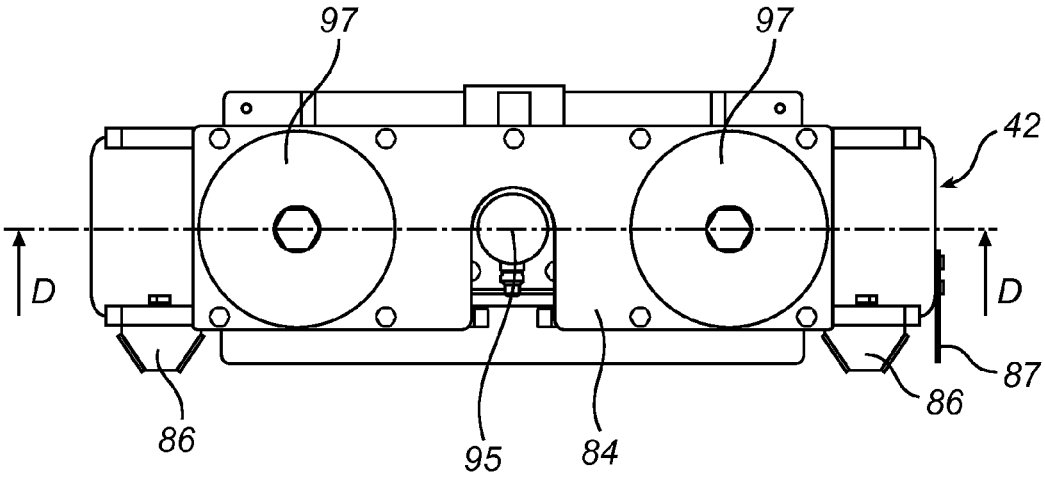
FIG. 4 is a top view and illustrates an adjustment device of the crusher shown in FIG. 1

As illustrated in FIGS. 2, 3*a* and 3*b* the adjustment device 42 comprises a supporting structure, in the form of a cross beam 84, and two connection portions, in the form of V-shaped guide blocks 86, which are arranged in opposite horizontal ends of the cross beam 84 and are fastened to the cross beam 84 by means of screws 88. Each of the two guide blocks 86 is received in a respective guide rail 90 mounted on the housing 2 and extending away from the housing 2, as illustrated in FIG. 2. Each guide rail 90 is provided with a receiving portion having a shape that corresponds to the shape of the connection part of the cross beam 84. In this embodiment each guide rail 90 is provided with a V-shaped groove 91 to form a V-shaped receiving portion that corresponds to the V-shaped guide block 86, as is best illustrated in FIG. 3*b*.

The guide blocks 86 can slide along the guide rails 90. Adjustment of the cross beam 84, and thereby of the curtain 28 which is connected to the cross beam 84 via the bars 44, to a correct position in relation to the impeller 4 with respect to the properties of the material to be crushed may be carried out by adjusting the position of cross beam 84 by having the guide blocks 86 slide relative to the guide rails 90.

As illustrated in FIG. 3*b* the crusher 1 further comprises retaining means, in the form of retaining bolts 92 and clamping plates 100, for tightening the guide blocks 86 to the guide rails 90. In this embodiment each guide block 86 is tightened by two retaining bolts 92, each of which is received in a respective bore of the respective clamping plate 100. The clamping plate 100 is provided with the two bores each having an inner thread, such that each retaining bolt 92 can be tightened to the clamping plate 100 without the need for any nut, as illustrated in FIG. 3*b*. The guide blocks 86 slide easily along the guide rails 90 when the bolts 92 are unscrewed, or at least loosened, and remain slidable, although only when a friction force is overcome, in a predictive way even when the bolts 92 are tightened. Optionally, the groove 91, and/or the guide block 86, may be provided with a friction coating 93. The friction coating, which may be, for example a proprietary disk brake lining material, provides a large and predictable friction force between the guide block 86 and the guide rail 90.

Each guide rail 90 is provided with a longitudinal slot 94, as is best illustrated in FIGS. 3*a* and 3*b*, which slot 94 extends along the guide rail 90 and is configured to receive the retaining means, in this case the retaining bolt 92, for tightening the guide block 86 to the guide rail 90. The slot 94 makes it possible for the guide block 86 with the retaining bolt 92 mounted therein to slide along the guide rail 90.

As mentioned above each of the guide rails 90 has a groove 91 with a shape that is complementary to the corresponding V-shaped guide block 86. The V-shaped guide block 86 in combination with the V-shaped groove 91 of the guide rail 90 provides for lateral guidance of the cross beam 84 and helps to prevent the cross beam 84 from twisting during crusher operation and adjustment.

After adjusting the position of the cross beam 84 to a desired position, i.e., a position at which the curtain 28 is located at a desired distance from the impeller 4 with respect to the size of the material that is to be crushed, the bolts 92 are tightened to such extent, for example to a predetermined torque, that a predetermined holding force in the form of the friction force between the V-shaped guide blocks 86 and the grooves 91 of the guide rails 90 is gene-rated. This predetermined holding force is large enough to prevent relative displacement between the cross beam 84 and the crusher housing 2 under normal crushing conditions. Hence, the bolts 92 are tightened to a specific tightening moment that provides the desired frictional force between the guide blocks 86 and the guide rails 90. The curtain 28 is thus prevented from pivoting around the first pivot shaft 36 under normal crushing conditions. If a bulky and non crushable object is introduced into the crusher 1 the forces exerted on the curtain 28, to which the adjustment device 42 is connected, is raised significantly. When such forces, denoted excessive forces, exceed the predetermined holding force threshold in the form of the friction force between the V-shaped guide blocks 86 and the grooves 91 of the guide rails 90, the guide blocks 86 slide along the guide rails 90, in a direction away from the housing 2 and away from the impeller 4, causing the curtain 28 to pivot around the first pivot shaft 36, thereby increasing the distance between the impeller 4 and the curtain 28 such that the non-crushable object can pass through the crusher 1. In this manner damage to parts of the crusher 1 caused by non-crushable objects introduced to the crusher 1 can be avoided.

Figure 5A:
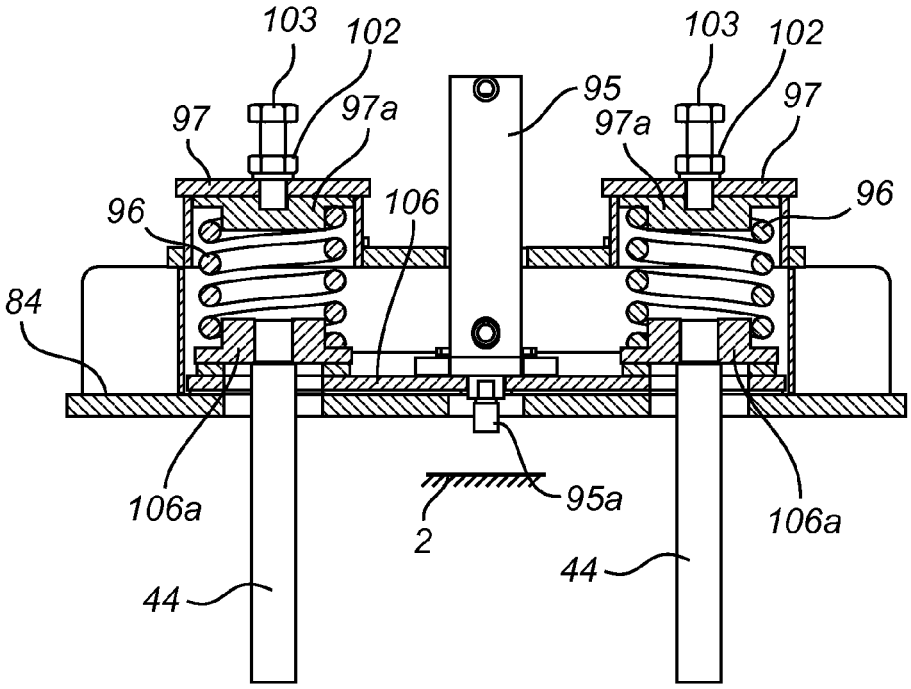
FIGS. 5*a-c* are sections of the adjustment device shown in FIG. 4, as seen along the arrows D-D.
Figure 5B:
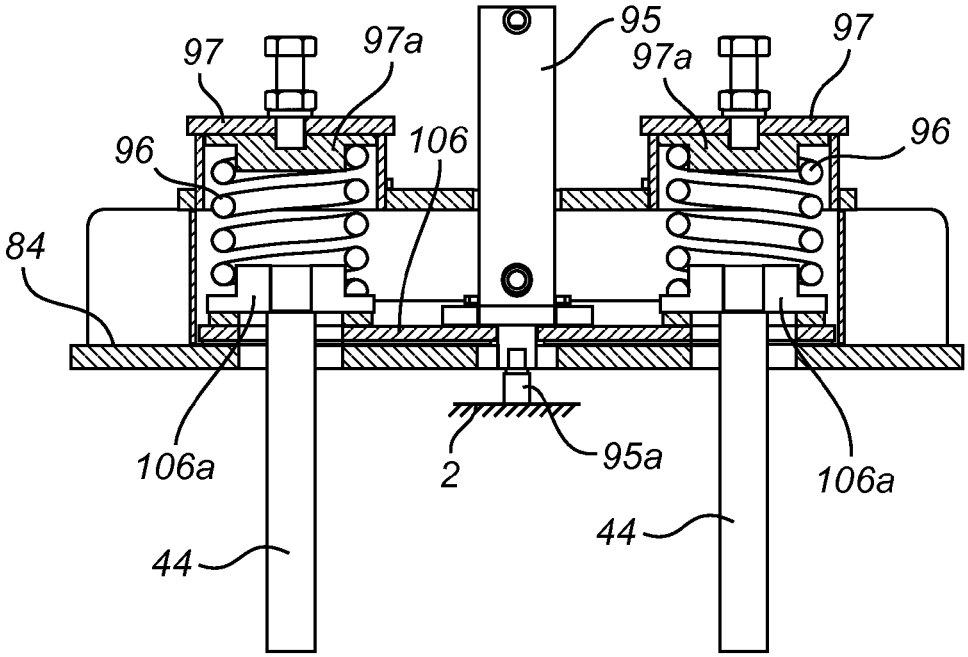
Figure 5C:
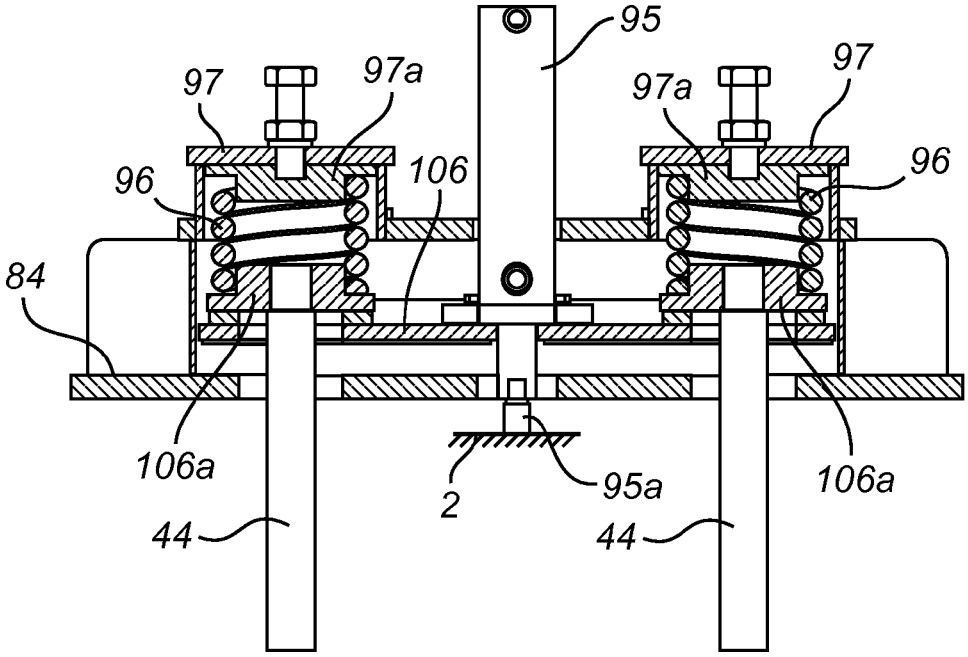

FIG. 4, FIG. 5*a*, FIG. 5*b* and FIG. 5*c* illustrate further details of the adjustment device 42. FIG. 5*a* illustrates the adjustment device 42 when the crusher is in normal crusher operation. FIG. 5*b* illustrates the adjustment device 42 when the position of the curtain 28 is adjusted. FIG. 5*c* illustrates the adjustment device 42 when the curtain 28 is temporarily retracted to empty the crusher of a minor blocking. The adjustment device 42 comprises a hydraulic cylinder 95 which is mounted on the cross beam 84 and is arranged to aid curtain adjustment.

The hydraulic cylinder 95 comprises a piston 95*a* which abuts, during an adjustment procedure, the roof of the housing 2, as illustrated in FIG. 5*b*. Hence, by supplying more or less of a pressurized fluid, such as a hydraulic medium, such as hydraulic oil, or pressurized air, to the hydraulic/pneumatic cylinder 95 the distance between the cross beam 84 and the housing 2 may easily be adjusted, such that a desired distance is obtained between the impeller 4, which is fixed to the housing 2, and the curtain 28, which is fixed, via the bars 44, to the cross beam 84 of the adjustment device 42. This has the advantage that the curtain 28 can be positioned in an easy and safe manner. Once the curtain 28 has reached its correct position it is locked in place by tightening the V-shaped blocks 86 against the guide rails 90 using the bolts 92, as described hereinbefore with reference to FIGS. 2, 3*a* and 3*b*. After adjustment and tightening of the retaining bolts 92 the pressure in the hydraulic cylinder 95 can be released, and the abutment against the housing 2 may be relieved. Hence, no pressure in the hydraulic cylinder 95 is needed during operation of the crusher 1, and the hydraulic cylinder 95 is inactive during crusher operation. Optionally, the piston 95*a* may be retracted such that it is no longer in contact with the housing 2 during crusher operation, as is illustrated in FIG. 5*a*.

The curtain 28, which is connected to the cross beam 84 of the adjustment device 42, may be repositioned in order to change crusher settings by first loosening the bolts 92 and then displacing the cross beam 84 along the guide rails 90 with the help of the hydraulic cylinder 95.

The adjustment device 42 further comprises resilient members, in the form of springs 96, as is best illustrated in FIG. 5*a*, that are pre-tensioned between the cross beam 84 and respective compression plates 97, for smoothening of the forces exerted on the curtain 28 by the material in the crushing chamber 82 during normal crusher operation. The degree of pre-tensioning of the springs 96 can be adjusted by loosening a locknut 102 and adjusting a tightening screw 103 in order to adjust the position of upper spring seats 97*a* relative to the compression plates 97. Such adjustment of the degree of pre-tensioning of the springs 96 is made to adjust the degree of smoothening of the forces exerted during normal crusher operation.

The adjustment device 42 is further provided with a mechanical safety device 98, illustrated in FIG. 2, for preventing the curtain 28 to come into contact with the beater elements 70 of the impeller 4 in case of failure of the adjustment device 42. The mechanical safety device 98 comprises a bar 99 which is mounted on the cross beam 84 and which is adjusted to such a length that it will abut the housing 2, in a similar manner as the piston 95*a* of hydraulic cylinder 95 abuts the housing 2 as illustrated in FIG. 5*a*, before the curtain 28 comes into contact with the impeller 4. Hence, after adjusting the cross beam 84 to its desired position in accordance with the above description, the bar 99 is mounted on the cross beam 84 in such a position that there is a clearance of typically 10-50 mm between the bar 99 and the housing 2. Hence, in a situation of failure of, for example, the guide blocks 86, the cross beam 84 may fall towards the housing 2, but not more than 10-50 mm before the bar 99 abuts the housing 2. Hence, the bar 99 prevents the curtain 28 from coming into contact with the impeller 4 in such a situation of guide block failure.

The retaining bolts 92 are arranged to hold the adjustment device 42 in a desired crusher operation position as long as the forces applied to the guide blocks 86 do not exceed the predetermined holding force. However, the adjustment means 42 is slidable in response to an excessive force that overcomes the predetermined holding force generated by the retaining bolts 92. The guide blocks 86 may then slide against the friction force generated between the guide blocks 86 and the grooves 91 of the guide rails 90 by means of the tightened retaining bolts 92 and the respective clamping plates 100.

When material is crushed in the crusher 1 forces are applied to the adjustment device 42 via the curtain 28. As long as the crusher 1 is fed with material of the type the crusher 1 is designed to crush the predetermined holding force is not exceeded which means relative displacement of the adjustment device 42 is prevented. However, it may happen that a non-crushable object of a certain size is introduced into the crusher 1. Such a non crushable object will exert excessive forces to the curtain 28 and the adjustment device 42. When a force exceeding the predetermined holding force is exerted on the adjustment device 42 the predetermined holding force, i.e. the friction force between the guide blocks 86 and the grooves 91 generated by the retaining bolts 92, is no longer enough to prevent the adjustment device 42 from sliding along the guide rails 90 away from the housing 2 and away from the impeller 4, such that the curtain 28 is moved away from the impeller 4. Hence, in an overload situation, i.e. when the predetermined holding force is exceeded, displacement of the curtain 28 is enabled, hence avoiding damage to the curtain 28 and the adjustment device 42.

As long as forces acting on the adjustment device 42 do not exceed the predetermined value the retaining bolts 92 prevents relative displacement of the adjustment device 42. The curtain 28 will thus maintain the position to which it is adjusted as long as no overload situation occurs. Since the curtain is held in position by means of mechanical fastening means, in the form of tightened bolts 92, no hydraulic pressure is needed to secure the curtain position. A reliable and simple overload protection is thus achieved.

The guide blocks 86 together form a slidable member which prevents relative displacement of the adjustment device 42 under normal conditions and which allows relative displacement in case of an overload situation.

FIGS. 5*a*, 5*b* and 5*c* further illustrate a crossbeam compression plate 106. The crossbeam compression plate 106 supports lower spring seats 106*a*. In the situation illustrated in FIG. 5*a* the crusher is in normal operation, and the cross beam compression plate 106 rests adjacent to the cross beam 84. Sometimes the crusher may become blocked with feed material that is to be crushed, because the feed has been too large in relation to the capacity of the crusher. Such blocking would normally not cause an overload situation of the type that would cause the forces on the curtain 28 to exceed the above mentioned predetermined holding forces of the guide blocks 86. A similar situation could occur if an un-crushable object of intermediate size enters the crusher 1. Such an object could block the crusher, without causing forces that exceed the predetermined holding force. In such situations a quick clearing sequence can be initiated. In the quick clearing sequence the hydraulic cylinder 95 is first activated such that the piston 95*a* abuts the housing 2, as illustrated in FIG. 5*b*. The hydraulic cylinder 95 is then further activated to such degree that it lifts the cross beam compression plate 106 from its position adjacent to the cross beam 84. Such lifting is made against the force of the springs 96, which become compressed between the upper and lower spring seats 97*a*, 106*a*, as is illustrated in FIG. 5*c*. The lifting of the cross beam compression plate 106 to the position illustrated in FIG. 5*c* causes a retraction of the adjustment bars 44 and hence a retraction of the curtain 28 away from the impeller 4, illustrated in FIG. 1. Depending on the size of the springs 96, such retraction could typically amount to 50-150 mm. Hence, the quick cleansing sequence illustrated with reference to FIG. 5*b* and FIG. 5*c* causes a temporary increase in the distance between the curtain 28 and the impeller 4 such that any blockage, which may be caused by excessive feed of material and/or an un-crushable object of intermediate size, can pass through the crusher 1. After the blockage has passed through the crusher, the hydraulic cylinder 95 is inactivated, causing the cross beam compression plate 106 returning, under the force exerted on it by the springs 96, to its normal position, as illustrated in FIG. 5*a*. Throughout the quick cleansing sequence the setting of the guide blocks 86 remains intact. Hence, with the hydraulic cylinder 95 and the cross beam compression plate 106 co-operating blockages can be cleared quickly from the crusher with minimal interruption of operation and with minimal manual efforts.

In the described embodiment retaining bolts 92 are arranged to hold the adjustment device 42 in a desired crusher operation position. It is realized that other means, including a small hydraulic cylinder or another actuator device, capable of generating the required friction force between the guide block 86 and the guide rail 90, may be used instead of bolts. According to one embodiment which will be described in more detail hereinafter the retaining means comprises two small hydraulic cylinders.

The crusher 1 is further provided with a position indicator device 85 which is capable of indicating the position of the curtain 28 relative to the impeller 4. The indicator device 85 may e.g. comprise a pointer, or an electronic sensor, mounted to the adjustable cross beam 84 for reading of the actual cross beam position. As described hereinbefore, a desired curtain position may be set by adjusting the cross beam 84 along the guide rails 90 using the hydraulic cylinder 95. The position of the curtain 28 in relation to the impeller 4 is thus derivable from the cross beam position.

In this embodiment the position indicator device 85 comprises a pointer 87 mounted at one end 84*a* of the cross beam 84 and a reading scale 89 arranged on the guide rail 90, as illustrated in FIG. 2. The actual cross beam position as well as the distance the cross beam 84 is being moved during an adjustment can thus easily be read on the reading scale 89. The distance between each line on the reading scale 89 equates to a known curtain movement. Hence, the pointer 87 indicates the actual cross beam position and thereby the actual setting of the curtain 28 which is connected to the cross beam 84 via the adjustment bar 44. The pointer 87 and the reading scale 89 thus enable reading of the actual curtain setting without access to the inside of the crusher 1.

Initially, i.e. before running a crusher operation, the cross beam 84 is normally adjusted until a desired distance between the wear plate 32 of the curtain 28 and a beater element 70 of the impeller 4 is reached. That is, the curtain 28 is set according to the specification of the actual crusher operation that is to be carried out. With the pointer 87 and the reading scale 89 the initial curtain setting may be recorded as a reference setting to aid further subsequent adjustments which may be needed due to e.g. wear of internal parts of the crusher 1. This will allow subsequent settings to be made quickly and in a simple manner without the requirement to access the inside of the crusher 1. By noting the position of the cross beam 84 after the initial setting, it would thus be a simple maintenance procedure to stop the crusher 1, adjust the cross beam 84 a certain distance to compensate for e.g. wear and run the crusher 1 again. This has the advantage that maintenance downtime can be reduced. Furthermore, the maintenance can be carried out in a very easy and safe manner since no work inside the crusher housing 2 is needed during subsequent adjustment of the curtain position.

Figure 6:
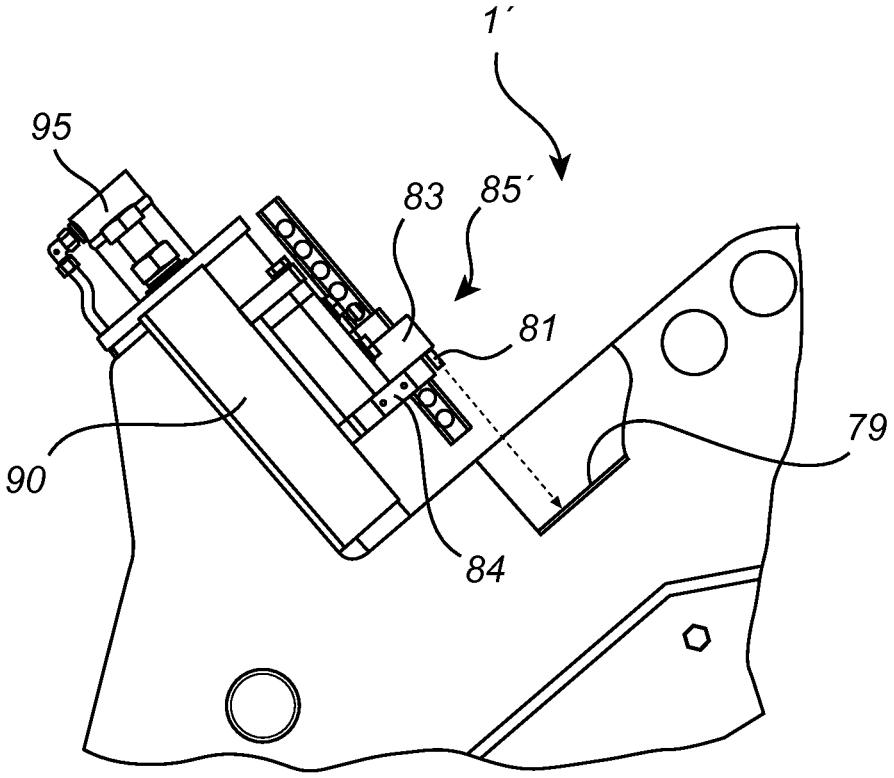
FIG. 6 is a side view and illustrates, schematically, a horizontal shaft impact crusher according to a second embodiment of the present invention.

FIG. 6 is a side view and illustrates, schematically, a crusher 1' according to a second embodiment. Many features disclosed in the first embodiment are also present in the second embodiment with similar reference numerals identifying similar or same features. Having mentioned this, the description will focus on explaining the differing features of the second embodiment. The second embodiment differs from the first embodiment in that the curtain position indicator device comprises an electronic measuring device 85' instead of a pointer. An electric sensor 81 is arranged on the cross beam 84 to give a digital readout of the actual cross beam position. The electronic sensor 81 may be any type of distance measuring sensor, per se well known in the art, such as an ultra-sonic sensor, a microwave sensor, an infrared sensor or a laser sensor, etc. The sensor 81 is held by a sensor housing 83 mounted to the cross beam 84. The sensor 81 is typically provided with a transmitter for transmitting a measurement signal and a receiver for receiving the measurement signal from a reflecting surface. The sensor 81 is arranged so as to be operable for transmitting a measurement signal in a direction toward a reflecting flat surface 79, i.e. a "target", of the crusher housing 2 as illustrated by the dotted line in FIG. 6, and for receiving the same from the reflecting surface 79. As mentioned hereinbefore the sensor 81 is attached to the cross beam 84 and will thus move together with movement of the cross beam 84 during a curtain position adjustment. Based on the measurement signal received from the reflecting surface 79 the position of the cross beam 84 can be calculated. The electronic sensor 81 is thus capable of monitoring the actual cross beam position as well as a movement of the cross beam relative to the crusher housing 2 to which the impeller 4 is arranged. The curtain position in relation to the impeller 4 is derivable from the actual cross beam position. The digital readout may be displayed on a screen mounted on or near the crusher 1'. Alternatively, the readout may be displayed through an electronic control system 142 of the crusher 1', as illustrated schematically in FIG. 9.

Alternatively, the electronic sensor 81 may be attached to the housing, measuring the distance to a reflecting surface of the cross beam 84 or another device connected thereto.

The electronic measuring device 85' provide for a very accurate reading of the curtain position and hence, initial setting as well as subsequent adjustments, using the hydraulic cylinder 95 as described hereinbefore, may be carried out in an easy and safe manner and with a high level of accuracy.

The second embodiment also differs from the first embodiment in that the retaining means comprises a hydraulic device. The hydraulic retaining device is arranged to hold the cross beam 84 in a desired position during a crusher operation thereby replacing the bolts 92 of FIG. 3*a*. Furthermore, the hydraulic retaining device is capable of loosening a holding force holding the guide blocks 86 to the guide rails 90 so as to allow adjustment of curtain position by a movement of the cross beam 84. Hence, the retaining means in this case comprises a hydraulic device arranged to enable tightening and loosening of each guide block 86 relative to its guide rail 90. Such a device is advantageous since remote control of the retaining means is enabled. Furthermore, the retaining means do not need to be adjusted by an operator using a tool.

Figure 7:
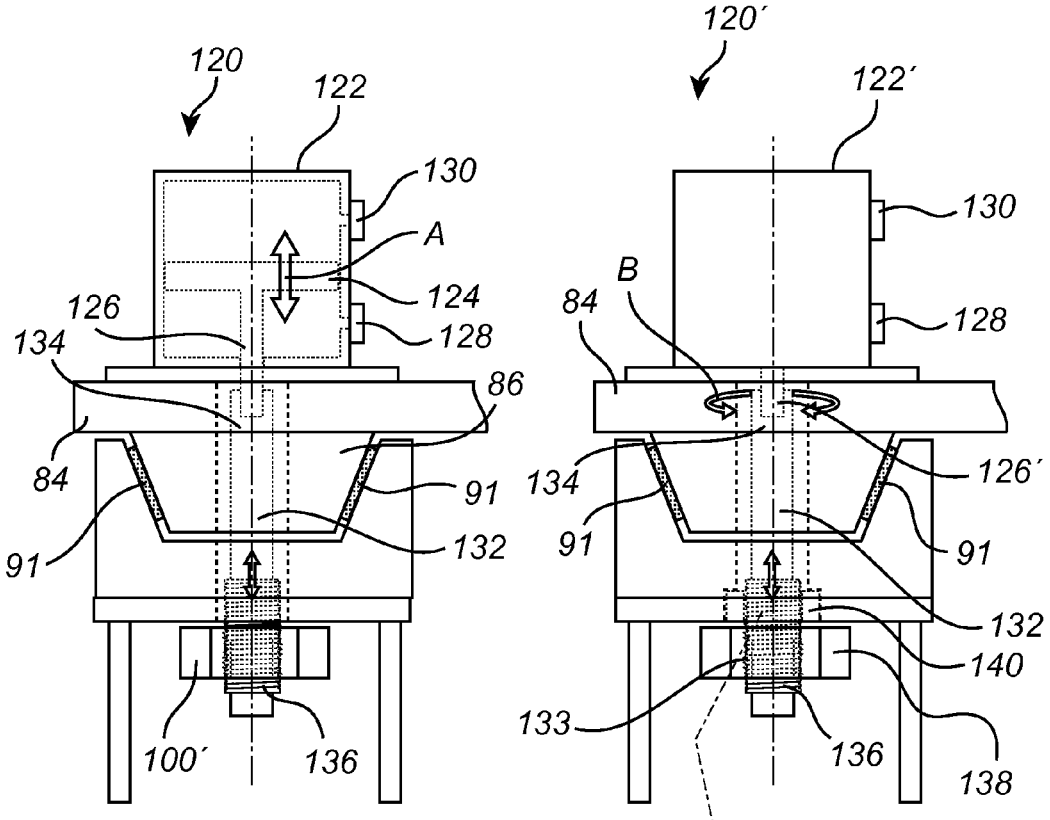
FIG. 7 illustrates, schematically, a hydraulic clamping device of the crusher shown in FIG. 6.

In this embodiment the hydraulic retaining device 120 comprises two hydraulic cylinders each of which is arranged on a respective guide block 86. FIG. 7 illustrates one of the hydraulic cylinders 122 mounted to a guide block 86. The hydraulic cylinder 122 comprises piston member 124 which is movable within the hydraulic cylinder 122, as illustrated by arrow A in FIG. 7. The hydraulic cylinder 122 further comprises a piston actuator 126 connected to the piston member 124 and fluid connections 128, 130 for supplying pressurized fluid to the hydraulic cylinder 122. The hydraulic retaining device 120 further comprises a retaining bar 132 and a clamping plate 100'. One end 134 of the retaining bar 132 is connected to the piston actuator 126 and the other end 136 of the retaining bar 132 is connected, e.g. by means of threads, to the clamping plate 100', as illustrated in FIG. 7.

By supplying a pressurized fluid, such as hydraulic oil, to the hydraulic cylinder 120 through the a first fluid connection 128 a movement of the piston member 124, and thereby the retaining bar 132 which is connected to the piston member 124 via the piston actuator 126, in a direction away from the guide block 86 is achieved. This movement will tighten the retaining bar 132 to the clamping plate 100' which abuts the guide rail 90. Hence, tightening of the guide block 86 to the guide rail 90 is thus carried out by introducing a pressurized fluid to the cylinder 122 through the connection 128. Loosening of the guide block 86 is carried out by supplying a pressurized fluid to the hydraulic cylinder 120 through the second connection 130.

Figure 8:
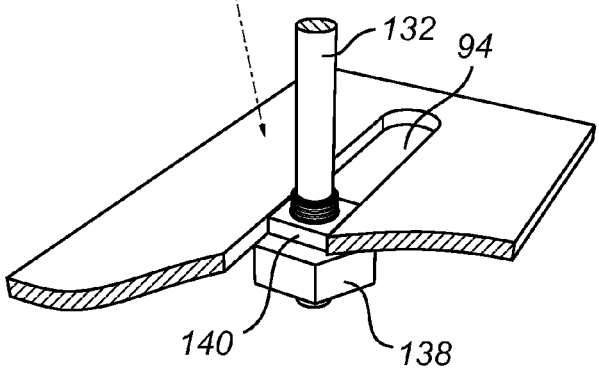
FIG. 8 illustrates, schematically, an alternative hydraulic retaining means.

In an alternative embodiment, the hydraulic cylinders 122 of the hydraulic device are replaced by hydraulic motors 122', which convert hydraulic pressure and flow into torque and angular displacement, i.e. rotation, as illustrated by arrow B in FIG. 8. FIG. 8 illustrates one of the hydraulic motors 120' of the hydraulic device 120' mounted on the cross beam 84. The hydraulic motor 120' has a shaft 126' to which one end 134 of a retaining bar 132 is connected. The other end 136 of the retaining bar 132 is received in a bore 133 of a clamping element 138. The clamping element 138 is provided with an inner thread which extends along at least a portion of the bore 133. The retaining bar 132 has a corresponding outer thread. The clamping element 138 is further provided with a square-shaped shoulder 140 which is received in the slot 94 of the guide rail 90, as illustrated in the enlarged part of FIG. 8, in order to prevent the clamping element 138 from rotating when the retaining bar 132 is rotated by the hydraulic motor 120'. Consequently, when the retaining bar 132 is rotated in one direction the clamping element 138 abuts the guide rail 90 and hence the guide block 86 is tightened to the guide rail 90. When rotated in the other direction the guide block 86 is loosened from the guide rail 90. When the guide block 86 is tightened to the guide rail 90 the cross beam 84 is held in a desired position and when it is loosened an adjustment of the cross beam 84 using the hydraulic cylinder 95 is possible. During such an adjustment the shoulder 140 slides along the slot 94 of the guide rail 90.

Rotation of the retaining bar 132 in one direction is achieved by supplying a pressurized fluid, such as hydraulic oil, to the hydraulic motor 120' through a first fluid connection 128 and rotation of the retaining bar 132 in the other direction is achieved by supplying a pressurized fluid to the hydraulic motor 120' through a second fluid connection 130.

Figure 9:
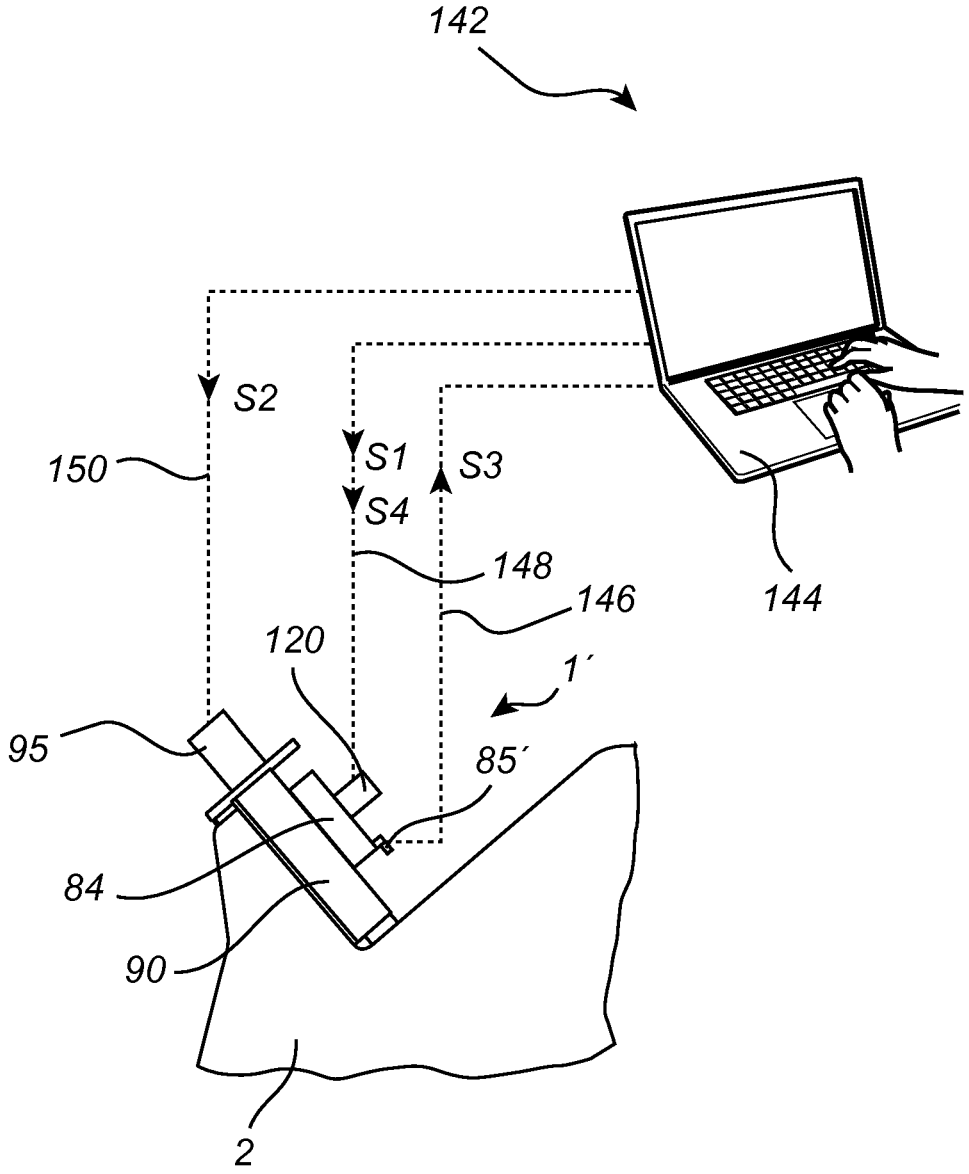
FIG. 9 is a side view and illustrates, schematically, the crusher shown in FIG. 6 together with an electronic control system.

FIG. 9 illustrates schematically a part of the crusher 1' described hereinbefore with reference to FIGS. 6 and 7 and serves to further illustrate advantages that may be achieved by an embodiment of the present invention. As described hereinbefore the crusher 1' is provided with an electronic measuring system 85' for determining the cross beam position, an actuator, such as a hydraulic retaining device 120 for tightening and loosening of the cross beam 84 and a hydraulic cylinder 95 for adjusting the cross beam 84 relative to guide rails 90 which are mounted to the crusher housing 2. The crusher 1' is connected to the electronic control system 142 comprising a computer 144, as illustrated schematically in FIG. 9. The computer 144 is connected to each of the electronic measuring device 85', the hydraulic retaining device 120, and the hydraulic adjustment cylinder 95 via connections 146, 148 and 150 respectively, as illustrated by the dotted lines in FIG. 9

As discussed hereinbefore adjustment of the curtain position may be required e.g. after a certain period of crusher operation due to wear of internal parts. When there is a need for an adjustment of the curtain position the control system 142 sends a signal S1 to the hydraulic retaining device 120 via connection 148, upon which signal S1 the hydraulic retaining device 120 loosen the guide blocks 86 from their respective guide rails 90 in order to permit the guide blocks 86 of the cross beam 84 to slide along the guide rails 90. Then, the control system 142 sends a signal S2 to the hydraulic adjustment cylinder 95 via connection 150 in order to initiate the adjustment. The cross beam 84 is then adjusted by means of the hydraulic cylinder 95 as described hereinbefore referring to FIG. 5*a*-5*b*, to a desired position. Based on a signal S3 from the electronic measuring system 85' to the control system 142 via connection 146 the movement of the cross beam 84 is monitored by the control system 142 and as soon as the desired adjustment has been carried out, i.e. the when the desired curtain position is reached, a signal S4 is sent to the hydraulic retaining device 120, upon which signal the hydraulic device 120 tightens each guide block 86 to its respective guide rail 90 in order to hold the cross beam 84 in the desired position.

It will be appreciated that numerous modifications of the embodiments described above are possible within the scope of the appended claims.

Hereinbefore it has been described that the curtain position indicator device comprises a pointer 87 mounted on the cross beam 84. Alternatively, the pointer may be replaced by an electric sensor capable of sending a measurement signal to, and receiving the same from, a reflecting surface of e.g. a projecting portion of the guide rail 90.

Hereinbefore it has been described that the crusher 1 is provided with a first curtain 28, and a second curtain 30 located downstream of the first curtain 28. It will be appreciated that a crusher may also be provided with only one curtain or even further curtains, such as a third curtain located downstream of the second curtain. An adjustment device 42 of the type that has been described in detail hereinbefore can be arranged for one, two, or all of the curtains 28, 30 of a crusher. Hence, the adjustment device 60 being operative for controlling the position of the second curtain 30 could be similar to the adjustment device 42.

Hereinbefore it has been described that the second adjustment device 60 operative for adjusting the position of the second curtain 30 may be of a similar design as the first adjustment device 42 operative for adjusting the position of the first curtain. It will be appreciated that the second adjustment device may, optionally, be arranged without a safety device 98, since the second curtain 30, hanging, as illustrated in FIG. 1, in a more or less vertical position, is less likely to come into contact with the impeller 4. Furthermore, the second curtain 30, illustrated in FIG. 1, may be connected, via the adjustment bars 62, to a cross beam 184, illustrated in FIG. 2. The cross beam 184 may be of a similar design as the cross beam 84, and is provided with a position indicator device 185, being similar to the position indicator device 85 and comprising a pointer 187 for indicating the position of the cross beam 184, and, hence, the position of the second curtain 30 relative to the impeller 4. As a further alternative, an electronic measuring device, similar to the electronic measuring device 85', may be arranged on the cross beam 184 to obtain an electronic reading of the position of the cross beam 184, and hence of the second curtain 30.

Hereinbefore it has been described, with reference to FIG. 9, that the electronic control system 142 may be utilized for adjusting the position of the cross beam 84, and, hence, for adjusting the position of the first curtain 28. It will be appreciated that the electronic control system 142 may also be utilized, in a similar manner, for controlling the position of the second curtain 30 in accordance with similar principles as described for the first curtain 28. Hence, the control system 142 may control the position of the first curtain 28, and/or of the second curtain 30, and/or of any further, third, fourth, etc., curtain of a crusher.

In the described embodiment the adjustment devices comprises a hydraulic cylinder 95 for positioning the curtain 28 into a correct position. It is, however, also possible to make the adjustment device entirely mechanical, which may reduce investment and maintenance costs.

Hereinbefore it has been described that the V-shaped guide blocks 86 are mounted on the adjustment device 42 and co-operate with V-shaped grooves on the respective guide rails 90. It will be appreciated that the opposite arrangement is also possible, i.e., that the adjustment device 42 could, as alternative, be provided with V-shaped grooves co-operating with guide rails being generally V-shaped blocks. Furthermore, other shapes are also possible, including guide blocks having a cross-section having the shape of a half-circle or some other suitable shape. Preferably, the shape is such that it provides both a predictable friction and guidance in the horizontal direction.

Hereinbefore it has been described that the adjustment device 42 comprises a compression plate 106 supporting spring seats 106*a* of each of the springs 96. In an alternative embodiment the first adjustment device 42 may comprise two compression plates, each of which support a respective spring seat. A number of hydraulic devices operative for moving each of the two compression plates may then be needed in order to provide a robust adjustment device.

In the described embodiment resilient members in the form of springs 96 are arranged to smoothen the forces exerted on the curtain 28. Alternatively, such a resilient member may be formed from another component having resilient characteristics, such as, for instance, a component formed from an elastic material.

It is further realized that the adjustment device may comprise a resilient member in the form of one single resilient member, such a single spring being, preferably, arranged on the cross beam 84 centrally between the two bars 44. More than two bars may also be provided.

The invention claimed is:

1. A horizontal shaft impact crusher comprising a crusher housing having an inlet for material to be crushed, an outlet for material that has been crushed, an impeller being mounted on a horizontal shaft in the crusher housing and being operative for rotating around a horizontal axis, a curtain against which material accelerated by the impeller may be crushed, and an adjustment bar for adjusting the position of said curtain relative to the impeller, wherein the crusher further comprises:

an adjustment device including a cross beam connected to the curtain via said adjustment bar and connected to a guide rail via a guide block slidably mounted in a complementary shaped receiving portion of the guide rail, said crossbeam being adjustable relative to the impeller, and a curtain position indicator device indicating the position of the cross beam relative to the impeller, thereby indicating the position of the curtain relative to the impeller.

2. A horizontal shaft impact crusher to claim 1, wherein said crossbeam extends parallel to the rotational axis of the impeller.

3. A horizontal shaft impact crusher according to claim 1, wherein said crossbeam is slidably arranged to the crusher housing.

4. A horizontal shaft impact crusher according to claim 3, wherein said crusher housing is provided with at least two guide rails to which said crossbeam is slidably connected, and retaining means which is arranged to hold, with a predetermined holding force, said cross beam in a crusher operation position relative to the guide rails.

5. A horizontal shaft impact crusher according to claim 4, wherein said retaining means comprises an actuator.

6. A horizontal shaft impact crusher according to claim 5, wherein said actuator is a hydraulic device comprising a hydraulic cylinder.

7. A horizontal shaft impact crusher according to claim 5, wherein said actuator is a hydraulic device comprising a hydraulic motor.

8. A horizontal shaft impact crusher according to claim 5, wherein a control system is arranged for controlling said actuator, and for adjusting the position of the cross beam relative to the impeller.

9. A horizontal shaft impact crusher according to claim 5, wherein said actuator is a pneumatic or a hydraulic device.

10. A horizontal shaft impact crusher according to claim 1, wherein said position indicator device comprises a pointer mounted to an end of the cross beam indicating the cross beam position relative the impeller.

11. A horizontal shaft impact crusher according to claim 10, wherein said position indicator device further comprises a pointer and a reading scale mounted on the housing for reading of the cross beam position.

12. A horizontal shaft impact crusher according to claim 1, wherein the position indicator device comprises an electronic sensor.

13. A horizontal shaft impact crusher according to claim 12, wherein the electronic sensor is an infrared sensor, an ultrasonic sensor, a microwave sensor, or a laser sensor.

14. A horizontal shaft impact crusher according to claim 12, wherein said sensor is mounted on the cross beam.

15. A horizontal shaft impact crusher according to claim 1, wherein a control system is arranged for receiving a signal from the curtain position indicator device indicating the position of the cross beam, and for adjusting the position of the cross beam in view of such signal.

16. A horizontal shaft impact crusher according to claim 1, wherein the guide rail is mounted on the crusher housing and extends away from the crusher housing.

17. A method for adjusting a horizontal shaft impact crusher comprising a crusher housing having an inlet for material to be crushed, an outlet for material that has been crushed, an impeller being mounted on a horizontal shaft in the crusher housing and being operative for rotating around a horizontal axis, a curtain against which material accelerated by the impeller may be crushed, and an adjustment device for adjusting the position of said curtain relative to the impeller, the adjustment device including a cross beam connected to the curtain via said adjustment bar and connected to a guide rail via a guide block slidably mounted in a complementary shaped receiving portion of the guide rail, the method comprising:

loosening, by means of an actuator, the cross beam to which said adjustment bar is connected, thereby permitting said cross beam to be adjusted relative to the impeller, adjusting the position of the cross beam, while monitoring the movement of the cross beam, until a desired position has been reached, and tightening, by means of the actuator, the cross beam to which said adjustment bar is connected.

18. A method according to claim 17, further comprising tightening by means of the actuator, the cross beam to a predetermined holding force, thereby permitting said cross beam to be adjusted relative to the impeller only if a force exceeding the predetermined holding force is transmitted from said curtain.

19. A method according to claim 14, wherein adjusting the position of the cross beam slidably moves the guide block relative to the complementary shaped receiving portion of the guide rail.

* * * * *